US009440713B2

(12) United States Patent
Hecht

(10) Patent No.: US 9,440,713 B2
(45) Date of Patent: Sep. 13, 2016

(54) DEVICE FOR PASSING A FLUID IN A TANK AND HAVING SUCH A DEVICE EQUIPPED VESSEL

(71) Applicant: Fr. Lurssen Werft GmbH & Co. KG, Schwanewede (DE)

(72) Inventor: Eberhard Hecht, Schwanewede (DE)

(73) Assignee: Fr. Lürssen Werft GmbH & Co. KG, Bremen (DE)

( * ) Notice: Subject to any disclaimer, the term of this patent is extended or adjusted under 35 U.S.C. 154(b) by 300 days.

(21) Appl. No.: 14/090,088

(22) Filed: Nov. 26, 2013

(65) Prior Publication Data

US 2014/0150707 A1 Jun. 5, 2014

(30) Foreign Application Priority Data

Dec. 3, 2012 (DE) ..... 10 2012 222 084

(51) Int. Cl.

| | |
|---|---|
| ***B67D 9/02*** | (2010.01) |
| ***B63B 27/24*** | (2006.01) |
| ***B67D 7/00*** | (2010.01) |
| ***B67D 7/04*** | (2010.01) |
| ***B67D 7/78*** | (2010.01) |

(52) U.S. Cl.

CPC ..... *B63B 27/24* (2013.01); *B67D 7/002* (2013.01); *B67D 7/0401* (2013.01); *B67D 7/78* (2013.01); *B67D 9/02* (2013.01); *Y10T 137/8807* (2015.04)

(58) Field of Classification Search

CPC .... B63B 27/24; B67D 9/02; Y10T 137/8807
USPC ..... 137/615
See application file for complete search history.

(56) References Cited

U.S. PATENT DOCUMENTS

| | | | | |
|---|---|---|---|---|
| 3,199,553 | A | 8/1965 | Garrett et al. | |
| 3,547,402 | A | 12/1970 | Millar | |
| RE27,343 | E | 4/1972 | Jameson | |
| 3,799,197 | A * | 3/1974 | Gibbons | 137/615 |
| 3,889,728 | A * | 6/1975 | Riche | 141/387 |
| 3,896,841 | A * | 7/1975 | Bahlke | 137/271 |
| 3,921,684 | A * | 11/1975 | Allen | 141/279 |
| 4,190,080 | A * | 2/1980 | Le Devehat | 137/615 |
| 4,220,177 | A | 9/1980 | Gill | |
| 4,231,398 | A * | 11/1980 | Gibbons | 137/615 |
| 4,276,917 | A * | 7/1981 | Fujita | 141/387 |
| 4,299,261 | A | 11/1981 | Talafuse | |
| 4,408,943 | A | 10/1983 | McTamaney et al. | |
| 4,416,306 | A * | 11/1983 | Le Devehat | 137/615 |

(Continued)

FOREIGN PATENT DOCUMENTS

| | | |
|---|---|---|
| DE | 1600550 A1 | 2/1970 |
| EP | 0012518 A1 | 6/1980 |

(Continued)

*Primary Examiner* — Kevin Murphy
(74) *Attorney, Agent, or Firm* — Wood, Herron & Evans, LLP

(57) ABSTRACT

An apparatus for transferring a fluid, in particular combustion fuel, to the tank of a vessel, having a flange that is firmly dedicated to the tank, a filler neck for receiving an external fuel hose element, and a pipe connecting the flange and the filler neck. The filler neck is pivotable about a bearing that is stationary in relation to the tank. The pipe features a plurality of pipe elements that are, at least in part, rotatably coupled to one another and to the flange and formed such that the filler neck is pivotable about at least two, preferably only two, predetermined pivot axes.

16 Claims, 4 Drawing Sheets

(56) References Cited

U.S. PATENT DOCUMENTS

| | | | | |
|---|---|---|---|---|
| 4,987,925 | A * | 1/1991 | Vroonland | 137/615 |
| 6,637,479 | B1 * | 10/2003 | Eide et al. | 141/387 |
| 2008/0310937 | A1 | 12/2008 | De Baan et al. | |
| 2009/0205343 | A1 | 8/2009 | Dupont et al. | |
| 2009/0272459 | A1 * | 11/2009 | Biaggi | 141/1 |
| 2010/0147398 | A1 | 6/2010 | Thomas et al. | |

FOREIGN PATENT DOCUMENTS

| | | | |
|---|---|---|---|
| FR | 2379473 | A1 | 9/1978 |
| FR | 2914903 | A1 | 10/2008 |
| GB | 1169599 | A | 11/1969 |
| NL | 46167 | C | 7/1939 |
| WO | 2008007033 | A1 | 1/2008 |
| WO | 2009141675 | A1 | 11/2009 |

* cited by examiner

DEVICE FOR PASSING A FLUID IN A TANK AND HAVING SUCH A DEVICE EQUIPPED VESSEL

BACKGROUND

The present invention relates to an apparatus for transferring a fluid, in particular combustion fuel, to the tank of a vessel.

The invention also relates to a vessel that is equipped with a tank and such an apparatus.

Apparatuses of the aforementioned type are used, for example, to refuel vessels that are in motion. The problem with fueling a vessel, in particular, from another vessel is that the supply vessel and the vessel to be fueled are inevitably moving relative to one another due to the sea and their travel speed, which is, at least at times, different.

The common procedure when fueling a vessel is to span a steel cable—a so-called tension leg—between the two vessels and to pass, along said cable, at least one flexible pipe from the supply vessel to the vessel to be fueled. A rigid neck, which may be referred to as the fuel hose, is arranged at the leading end of the pipe, which hose may penetrate the filler neck of the transfer apparatus on the vessel to be fueled and secured or coupled there.

An apparatus, also referred to as the "Parker coupling", is known from DE 16 00 550 B2, where the filler neck of the vessel to be fueled is pivot-mounted in a stationary bearing at the body of the vessel. This is to facilitate the adjustment of the filler neck when inserting the fuel hose. In the above-described prior art, the tensile stress exerted via the cable during insertion is supposed to force an automatic alignment of the fuel hose and filler neck. It has been proposed to fasten the filler neck to the bearing by means of a holding element. The holding element is equipped with a stopper for a wire rope, with which the fuel hose is pulled from the supply vessel to the vessel to be fueled.

In prior art and in DE 1 600 550 B2, the filler neck is connected to the tank of the vessel by means of a flexible hose. To ensure the necessary mechanical load capacity of the hose line, the latter must be quite heavy and feature comparatively thick walls and is therefore difficult to handle. Normally, the hose is—on the one hand—connected to a flange of the transfer apparatus for fueling purposes, and—on the other—to a flange that is firmly connected to the vessel, which is connected to the tank by means of a rigid pipe. This means that in order to connect the hose, the crew must first collect the heavy hose, seal it off at either flange by means of seals, and screw it in place by tightening a plurality of screws. After fueling, the hose is released at either flange and stored in an appropriate place on the vessel. It is obvious that the assembly of the hose requires a lot of work and is prone to errors, especially since such work must be performed by the crew on deck in any weather conditions and due to the fact that the hose is comparatively heavy and rigid, given its dimension and size.

The object of the present invention was thus to provide an apparatus for transferring a fluid medium, which apparatus can be handled more easily and safely and which, at the same time, ensures improved operating safety.

SUMMARY

This object has been solved by an apparatus according to the invention of the aforementioned type, whereby the pipe features a plurality of pipe elements that are rotatably coupled to each other and to the flange and shaped such that the filler neck is pivotable about at least two, and preferably exactly two, predetermined pivot axes. The apparatus may include a flange that is firmly dedicated to said tank, a filler neck for receiving an external fuel hose element, and a pipe connecting the flange and the filler neck, with said filler neck being pivotable about a bearing that is stationary in relation to the tank.

The invention is based on the following thoughts or, respectively, brings about the following advantages: on the one hand, the pivoting capacity of the filler neck allows for compensating for the relative movements between the fuel hose element and the filler neck that occur during operation. On the other hand, the fact that the filler neck can be pivoted about two axes, as well as the design of the pipe by means of pipe elements, allow for designing the apparatus as a particularly flexible structure having a rotationally fixed connection to the flange. However, it is also possible to design the bearing such that it allows for pivoting about more than one axis, as is the case, for example, with ball-and-socket-joints or gimbal bearings.

When using the apparatus on a vessel, one must consider, in particular, two types of relative movements between the filler neck and the fuel hose element. One the one hand, a relative movement in longitudinal direction is caused by the, at times, different travel speed of the vessels. On the other hand, relative movements of the vessels are caused, in particular, by the vessels' rolling movements. The filler neck has two pivot axes, with the relative movement in the longitudinal direction being preferably compensated for by the pivoting capacity about a first pivot axis and the relative movement about the longitudinal axis being compensated for by the pivoting capacity about a second pivot axis. Thus, the relative movements occurring during operation can be well compensated for by means of the two pivot axes.

The mounting of the filler neck that, according to the invention, is pivotable about two axes further allows for an advantageous saving of time, more security, lower susceptibility to damage and less environmental harm caused by leaking fuel. According to the invention, it is no longer required for the crew to assemble a flexible hose as a pipe or to disassemble it; thanks to the pivotable arrangement, it is instead possible to realize a permanent pipe composed, in essence, of rigid pipe elements that is flexible in itself and that does not have to be assembled for, or disassembled after, each and every fueling. Another step that is no longer necessary compared to prior art is the transportation and assembly of a Parker coupling at that side of the vessel that is provided for fueling. The safety risks for the crew and the environmental risks that existed in prior art and resulted from assembly errors that could occur under difficult circumstances are hence clearly reduced. Crew safety and environmental safety are now clearly improved. The complex provision, transportation and storing of hoses is also avoided. Here, the use of pipe elements is clearly advantageous over the use of those hoses that were employed before.

Pipe elements in terms of the invention means pipe elements that can bear their load without becoming significantly deformed. Here, stress is exerted on the pipe elements, inter alia, as a result of the weight and dynamic forces that occur during the relative movement of the pipe elements to each other.

Pipe elements as compared to the flexible pressure lines in question that are normally used in tank technology are thus comprised of a rigid material and can therefore be designed such as to safely withstand high pressures and fuels, such as diesel or fuel oil, and their corrosive properties. Hence, pipe elements according to the invention may be produced from a metal material, in particular steel, which is not only resistant to commonly used fuels, but also to sea water and other media that can be found in and around a vessel.

Typically, the medium to be filled into the respective tank by means of an apparatus according to the invention will be a fuel used for a combustion engine. However, it is also conceivable to fill other liquids, such as water or other supply liquids, into a tank using an apparatus according to the invention.

The alignment of the filler neck's pivot axes and of the pipes' rotation axes is determined subject to the arrangement of the apparatus on the vessel. Normally, the apparatus is arranged centrally in a section between the vessel's backboard or starboard side, with the opening of the filler neck that receives the fuel hose element being aligned towards the ship's side. Subject to that, the pipe elements are formed and rotatably coupled such that the pipe shows a degree of freedom that allows for the filler neck to pivot about the two pivot axes at the bearing.

According to one advantageous embodiment of the apparatus according to the invention, the pivot axes are aligned vertically to each other and transversely to the longitudinal axis of the filler neck, with the first pivot axis being aligned vertically and the second pivot axis horizontally in relation to the vessel. This embodiment allows for a particularly effective balancing of the vessels' relative movements. The first pivot axis serves essentially for balancing relative movements in the longitudinal direction. The second pivot axis serves for balancing asynchronous rolling movements of the vessels. Here, the longitudinal axis of the filler neck means the longitudinal axis running vertically through the opening of the filler neck. The angle between the axes is essentially 90° in each case. The horizontal and vertical alignment of the pivot axes means in relation to the deck of the vessel.

The apparatus according to the invention is particularly advantageously further developed by an embodiment whereby the rotation axis of the pipe element that is coupled at the flange and the rotation axis of one of the pivot axes are aligned coaxially to each other. Thus, the pipe element coupled at the flange and the filler neck are synchronously pivotable about the rotation axis or, respectively, pivot axis, which considerably simplifies the design of the apparatus and the pivoting of the filler neck. The pivoting of the filler neck about the pivot axis is made possible by the rotation of just one pipe swivel joint. Thus, plenty of room for the maneuvering of the filler neck can be ensured with a relatively small number of pipe elements and pipe swivel joints.

What is moreover preferred is an embodiment of the apparatus according to the invention whereby the pipe is formed by at least three pipe elements and whereby the pipe elements of the pipe that are adjoining on the face side are connected to each other by one pipe swivel joint in each case. According to this embodiment, the pipe is designed like a pair of swivel joint scissors. The pivoting connection by means of the pipe swivel joints, which is provided according to the invention, ensures the necessary flexibility of the filler neck despite the rigid embodiment of the individual pipe elements and is, moreover, particularly easy to realize. Pipe swivel joints means all kinds of pipe swivel joints that allow for a relative twisting of two pipe elements and seal the connection between the pipe elements. Pipe swivel joints with low friction resistance are particularly advantageous for use in the apparatus according to the invention.

Preferably, the invention is further developed in that the rotation axis of one of the pipe swivel joints is aligned vertically to the rotation axis of at least another one of the pipe swivel joints. The rotation axes are thus aligned parallel to one of the pivot axes to thus allow for a pipe that interacts well with the pivot axes of the filler neck.

According to the invention, the rotation axes of the pipe swivel joints are arranged such as to allow for a change in the position of the pipe elements about a first rotation axis and at least a second rotation axis, which is aligned transversely to the first rotation axis. Because of the twist capacity of the pipe elements thus achieved, the pipe designed according to the invention may compensate for the pivoting of the filler neck about at least two pivot axes. The articulated pipe, which according to the invention is formed by rotatably connected pipe elements, is thus capable of compensating for the pivoting of the filler neck in relation to the fixed flange of the tank by twisting the pipe elements relative to one another, while largely minimizing the torsion forces or other forces.

According to another preferred embodiment of the apparatus according to the invention, the pipe is formed by four pipe elements. In this way, the pipe can be composed in a particularly cost-efficient manner and with little effort. At the same time, the pipe, having four pipe elements, is capable of compensating for the pivoting of the filler neck across a particularly large range of movement.

A cost-efficient and simple, rotatable connection between the pipe and the flange can be realized by means of yet another advantageous embodiment of the apparatus according to the invention, whereby the pipe is connected to the stationary flange by means of a pipe swivel joint.

For example, one embodiment of an apparatus according to the invention that is particularly suitable for practical use on vessels or the like typically comprises four pipe elements, with one of these pipe elements which is bent at an angle of 90° being connected to the flange of the tank through a first pipe swivel joint. A second pipe element which is bent at an angle of 180° is connected to the first pipe element through a second pipe swivel joint. A third pipe element connects to the second one through a third pipe swivel joint. This third pipe element has a long section that is dedicated to the second pipe element and merges into a section that is bent at an angle of 180°. A fourth pipe element that is also bent at an angle of 90°, and to the other end of which the filler neck is attached in a rotationally fixed manner, is attached to the face side of the bent section of the third pipe element through a fourth pipe swivel joint. The rotation axes of the second, third and fourth pipe swivel joints are aligned transversely to the rotation axis of the first pipe swivel joint that is connected to the flange of the tank. Thus, the second, third and fourth pipe elements, together with the pipe swivel joints that are dedicated to them, form a pair of so-called "swivel joint scissors" that are capable of compensating for a movement transversely to the alignment of the rotation axes of their pipe swivel joints.

What is furthermore advantageous is an embodiment of the apparatus according to the invention whereby the pipe is connected to the filler neck in a rotationally fixed manner. This way, a direct force transmission is created between the filler neck and the pipe. As soon as the filler neck is pivoted, the pipe elements of the pipe will turn accordingly.

According to one preferred embodiment of the apparatus according to the invention, the second pivot axis is arranged at a distance from the first pivot axis of the stationary bearing. With this embodiment, the bearing can be realized with simple means. The pivot axes can thus be realized by means of two different bearings. Moreover, the swivel range of the filler neck can be produced in many different variants so as to be adaptable to different circumstances, e.g., limited freedom of movement, of a vessel.

A particularly preferred and easily realizable embodiment of the apparatus according to the invention features a filler neck that is held at a holding element located in the stationary bearing, with said holding element being pivotable about the first pivot axis and the filler neck being mounted pivotably about the second pivot axis at the holding element.

A secure and solid mounting of the filler neck can be achieved such that the filler neck is pivotable about one single pivot axis at the stationary bearing point.

Preferably, the apparatus according to the invention is further developed such that the filler neck is pivotable about the first pivot axis within a range of 300° through 180° to 60° and about the second pivot axis within a range of 0° to 60°; an operating range of at least +/−30° degrees relative to the athwartship direction (in relation to the vessel) is considered to be the preferred operating range. This way, the filler neck compensates for even extreme movements of the vessels relative to one another and ensures that the fuel hose element remains inside the filler neck while the fluid is being transferred. In each case, and measured from the neutral position, the filler neck can be pivoted by at least 120° to the left or, respectively, right about the first pivot axis and by 30° up or down about the second pivot axis.

The apparatus according to the invention can be moreover enhanced such that the filler neck is connected to the pipe formed by the pipe elements such that it can be detached. This may be advantageous in the case of repairs.

What is moreover preferred is an embodiment of the apparatus according to the invention whereby the apparatus features a securing means for stashing and/or securing the apparatus. The apparatus can thus be stashed or secured to prevent the filler neck from uncontrollably swiveling about and/or to protect it from corrosion. Means that could be used for securing include, among others, a casing or canvas cover that can be put over the apparatus, and/or a fixing device for clamping the apparatus.

The object of the invention is furthermore solved by a second aspect of the invention relating to a vessel with a tank and an apparatus designed according to one of Claims 1 to 13 for transferring a fluid to the tank. If installed on a vessel, an apparatus according to the invention will allow for a particularly safe and, at the same time, easy fueling even in rough weather. This is true, in particular, if the tank is arranged in the hull and if the filler neck is firmly mounted to a superstructure that is located in a central place on deck of the vessel.

What is particularly advantageous is an embodiment of the vessel according to the invention whereby the tank is arranged in the hull and the filler neck is arranged at a superstructure on the deck of the vessel. The filler neck may be arranged both centrally (meaning approximately in the area of the vessel's longitudinal axis) and off-center (meaning on the backboard and/or starboard side of the vessel). The latter arrangement allows for the filler neck to be installed even on such vessels that do not allow for a central arrangement, without having to waive the benefits of the filler neck, in particular the abolition of assembly and disassembly work. It is also preferred if the transfer apparatus is arranged on the backboard and/or starboard side of the vessel.

BRIEF DESCRIPTION OF THE SEVERAL VIEWS OF THE DRAWINGS

Hereinafter, the invention will be explained in more detail based on an exemplary embodiment. The following is shown in.

DETAILED DESCRIPTION

Figure 1:
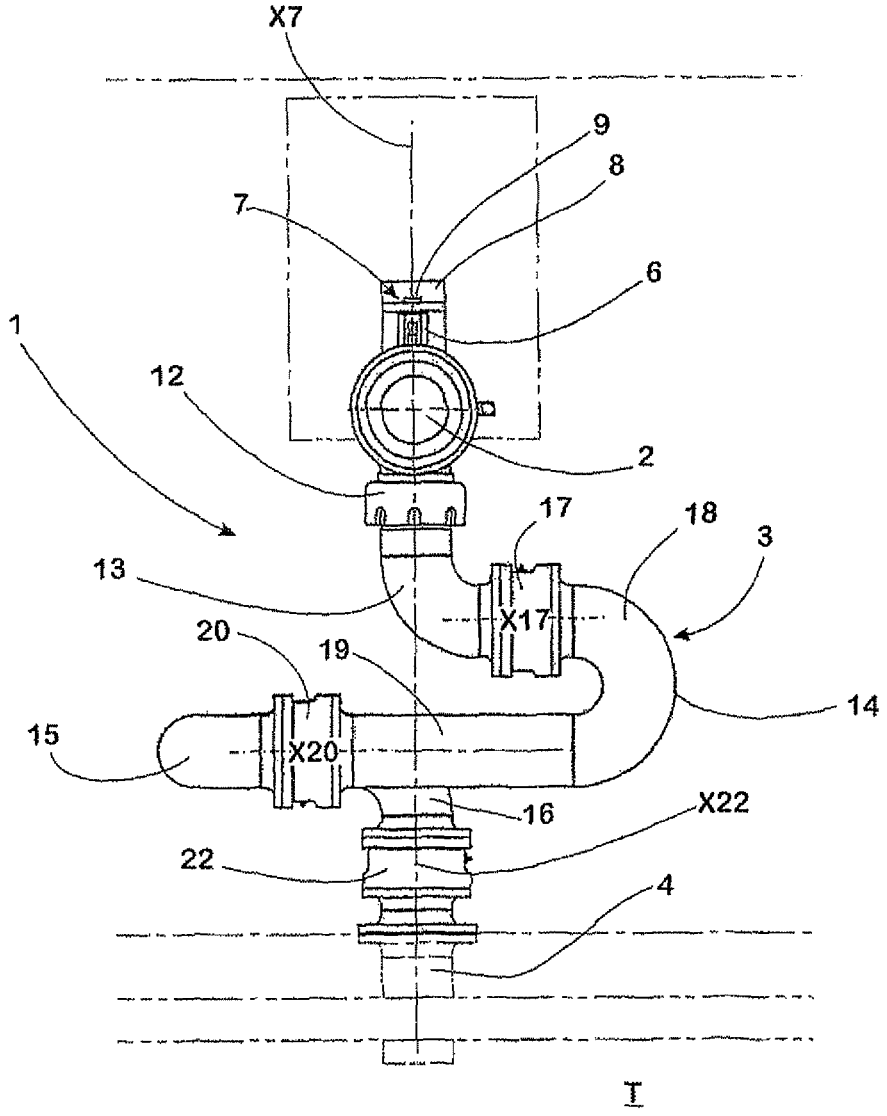
FIG. 1 is a frontal view of an apparatus used for filling the tank of a vessel.
Figure 2:
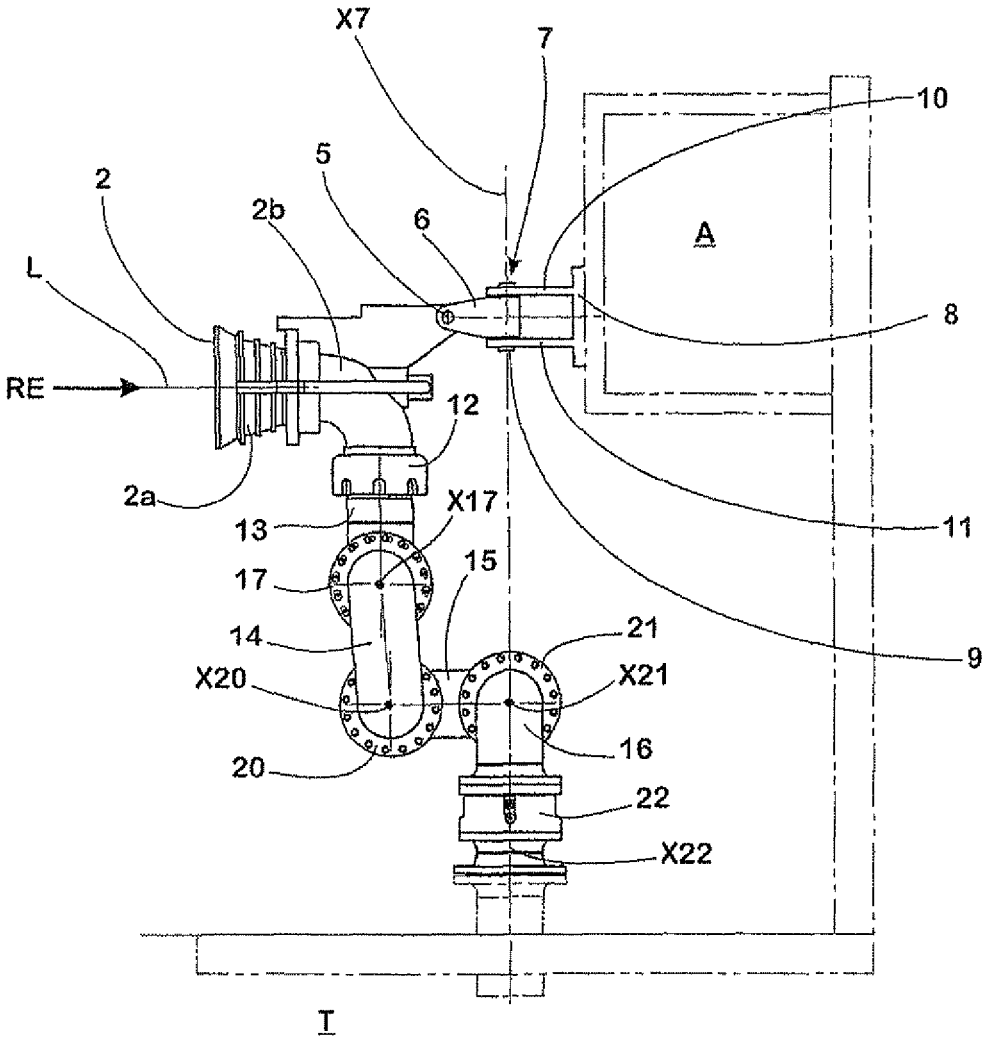
FIG. 2 is a lateral view of the apparatus pursuant to FIG. 1.

FIG. 1 shows an apparatus 1 according to the invention for transferring a combustion fuel to a tank T of a vessel S, having a flange 4 that is firmly dedicated to said tank T, a filler neck 2 for receiving an external fuel hose element and a pipe 3 connecting the flange 4 and the filler neck 2. The filler neck 2 is movably mounted about a bearing 7 that is stationary in relation to the tank T. Pipe 3 features a plurality of pipe elements 13, 14, 15, 16 that are rotatably coupled to one another and to the flange and formed such that the filler neck 2 is pivotable about two predetermined pivot axes X7, X5 at bearing 7.

Apparatus 1 is coupled, by means of bolts and brackets, to a superstructure A or base that is installed on deck D of vessel S, and is positioned centrally in relation to width B of vessel S. Filler neck 2 is connected to filler flange 4 of tank T, which is firmly installed on deck D of vessel S, via pipe 3, with tank T being arranged in the hull of vessel S. Superstructure A is arranged at such a distance to the adjacent superstructures of vessel S as to allow free access to apparatus 1 from either longitudinal side S1, S2 of vessel S.

Figure 4:
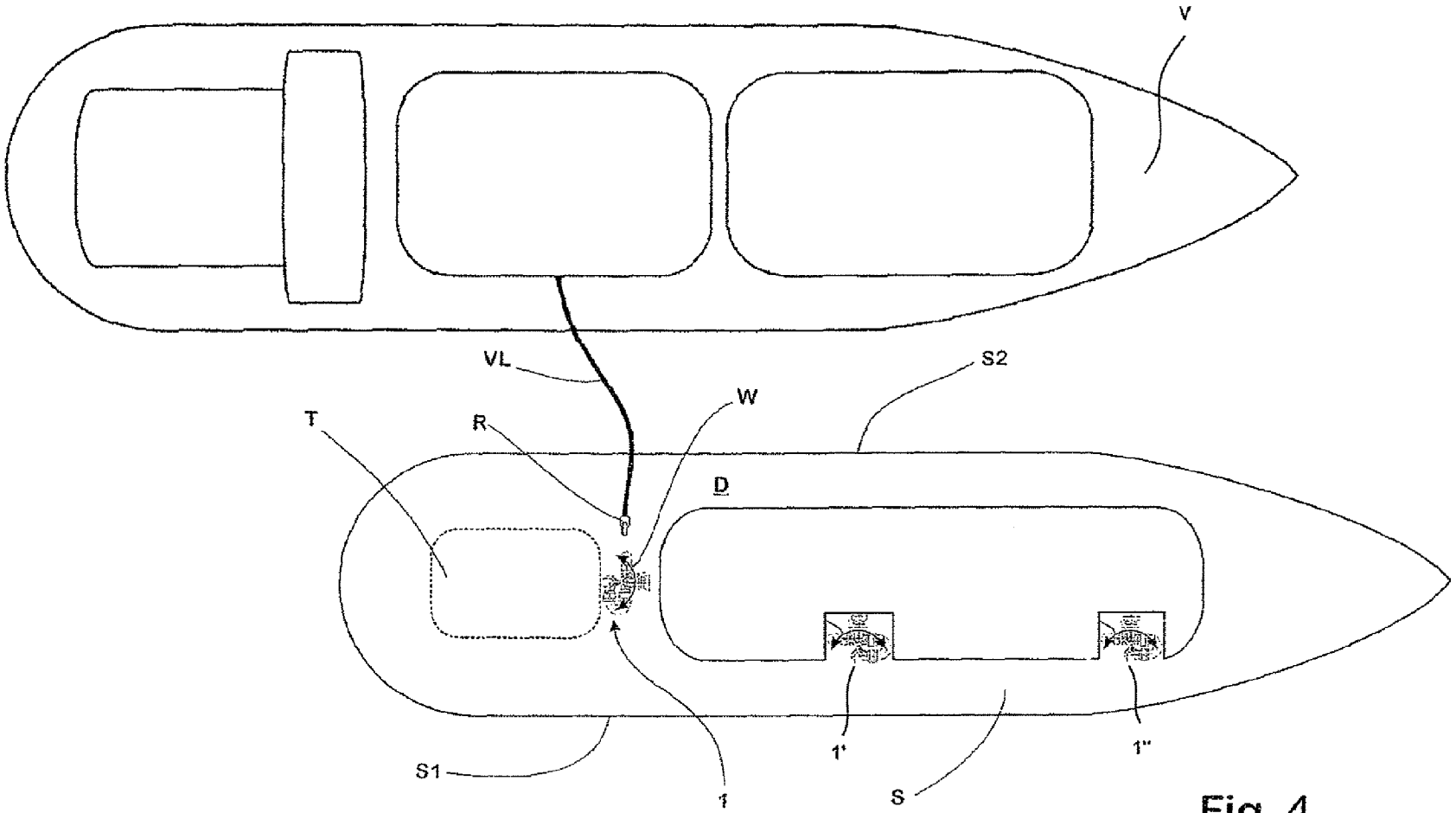
FIG. 4 is a top view of a vessel that is equipped with an apparatus pursuant to FIGS. 1 to 3.

As can be seen in FIG. 4, the apparatus may be arranged, for example, centrally (meaning approximately in the area of the vessel's longitudinal axis) or off-center (meaning on the backboard and/or starboard side of the vessel). Several variants are shown as examples in FIG. 4. In the rear area of the vessel, apparatus 1 is arranged centrally, and in the central or, respectively, front area of the vessel, there are two places shown on the starboard side, where apparatuses 1 according to the invention are positioned as examples. Normally, apparatus 1 is installed such that the filler neck 2 is aligned sidewards to allow for an easy insertion and coupling of a fuel hose using the steel cable.

Filler neck 2, which is designed in a manner that is basically known, features a pipe section 2*b* that leads away from its feed hopper 2*a* and is bent downward at an angle of 90°, to which pipe 3 is connected.

Filler neck 2 is mounted to a holding element 6 by means of a pivot bearing 5, the pivot axis X5 of which is aligned horizontally. At the same time, holding element 6 is mounted to yet another pivot bearing 7 that is provided for at a U-shaped second holder 8, which is attached, in a rotationally fixed manner, to the superstructure A of vessel S.

Pivot bearing 7 is formed by a bolt 9, the ends of which are resting in respectively formed openings that are molded into the flanks 10,11 of holder 8 and which at the same time reaches, with sufficient clearance, through a bearing lug that is not visible here and that is molded into the end section of holding element 6, which end section is arranged between flanks 10, 11 of holder 8.

Filler neck 2, which is borne by holding element 6, is thus pivotably mounted, on the one hand, about the vertically aligned pivot axis X7 of bearing 7 and, on the other, about the horizontally aligned pivot axis X5 of bearing 5 at holding element 6.

Filler neck 2 is connected, in a rotationally fixed manner, to that end of pipe 3 that is dedicated to filled neck 2 by means of a screw connection 12 that can be disconnected with the respective use of strength.

Figure 3:
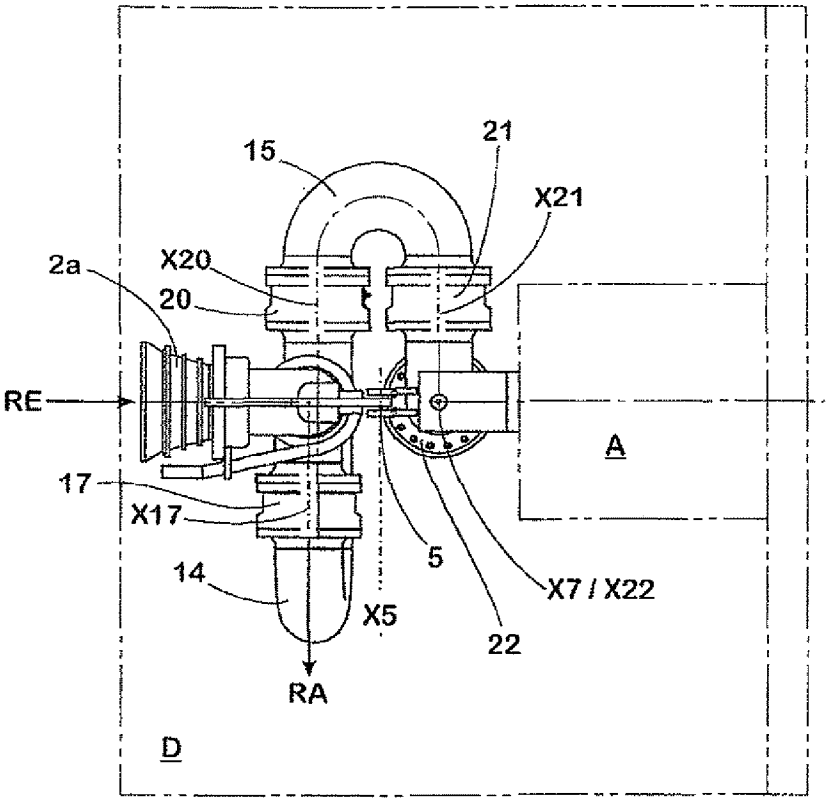
FIG. 3 is a top view of the apparatus pursuant to FIGS. 1 and 2.

Pipe 3 is formed by four rigid pipe elements 13, 14, 15, 16 consisting of a steel material which is protected from corrosion by an appropriate surface coating. The first pipe element 13 that is firmly connected to filler neck 2 is bent at an angle of 90° such that its face side, which is dedicated to the second pipe element 14, is aligned vertically, in essence. The first pipe element 13 is aligned in relation to filler neck 2 such that the inflow direction RE, in which the fuel flows into filler neck 2, and the outflow direction RA, in which the fuel exits the first pipe element 13 in the top view (FIG. 3), comprises an angle of approx. 90°.

A first pipe swivel joint 17, the pivot axis X17 of which is aligned horizontally, is arranged between the first pipe element 13 and the second pipe element 14.

Section 18 of the second pipe element 14, which connects to the first pipe swivel joint 17, is curved at an angle of 180° and subsequently merges into a straight second section 19 of pipe element 14. The length of said straight second section 19 of pipe element 14 is dimensioned such that—if looked at from the top (FIG. 3)—it is aligned approximately centrally in relation to the longitudinal axis L of filler neck 2.

The third pipe element 15 is connected to the end of the straight section 19 of the second pipe element 14 by means of a second pipe swivel joint 20. Pivot axis X20 of the second pipe swivel joint 20 is also aligned horizontally.

The third pipe element 15 is curved at an angle of 180° and connected to the fourth pipe element 16 by means of a third pipe swivel joint 21. Pivot axis X21 of the third pipe swivel joint 21 is also aligned horizontally, so that the pivot axes X17, X20 and X21 run parallel to each other.

The fourth pipe element 16 is also bent at an angle of 90° like the first pipe element 14, and its end, which is dedicated to flange 4, is coupled to flange 4 by means of a fourth pipe swivel joint 22. Pivot axis X22 of the fourth pipe swivel joint 22 is aligned vertically, i.e., transversely to rotation axes X17,X20,X21 of the other pipe swivel joints 17,20,21, and flush to pivot axis X7 of bearing 7 at holder 8. Pivot axes X7 and X22 thus overlap.

In order to be positioned for fueling purposes, filler neck 2 is aligned by being pivoted about pivot axes X5 and X7 with the aid of, in particular, the force exerted by the steel cable such that the fuel hose R, which is arranged at the end of a service pipe VL that is advanced by the supply vessel V, can be safely inserted into feed hopper 2*a* of filler neck 2. The steel cable may engage, for example, adjacently and preferably above filler neck 2 (not shown in the figures).

The swivel range W of at least 240° about the vertical pivot axis X7, which is ensured by bearing 7 and by the rotating movement of pipe elements 13, 14, 15, 16, allows for an alignment of filler neck 2 both in the direction of longitudinal side S1 and longitudinal side S2 of the vessel, so that vessel S can be fueled regardless of whether supply vessel V is positioned at longitudinal side S1 or at longitudinal side S2 of vessel S. Filler neck 2 can moreover be pivoted about the second pivot axis (X5) within a range of 0° to 60°. In the case that the apparatus 1 is positioned laterally at the backboard or starboard side, the apparatus is preferably designed such that filler neck 2 can be pivoted by at least +/−30° degrees against the athwartship direction.

As soon as the fuel hose R sits properly in filler neck 2, it is secured in filler neck 2 by means of principally known locking devices, which are not shown here, so as to prevent the hose R from accidentally disengaging from filler neck 2.

The pivoting about pivot axes X5, X7, which filler neck 2 has to perform in order to align itself so that fuel hose R can be connected and to compensate for the movements of fuel hose R, such movements inevitably being caused by the relative movements of vessel S and supply vessel V during fueling, is compensated by pipe 3 through a respective mutual twisting of pipe elements 13, 14, 15, 16 that is facilitated by pipe swivel joints 17, 20, 21, 22.

Because of the freely rotatable connection of the individual pipe elements 13, 14, 15, 16 among each other, such twisting takes place almost force-free, so that, on the one hand, a permanently safe functioning of apparatus 1 and, on the other, easy and safe handling by the staff operating this apparatus can be ensured even in rough sea conditions.

REFERENCE SIGNS

1 Apparatus for filling fuel tank T
2 Filler neck
2*a* Feed hopper of filler neck 2
2*b* Pipe section of filler neck 2
3 Pipe
4 Filler flange
5 Pivot bearing
6 Holding element
7 Pivot bearing
8 Holder
9 Bolt
10,11 Flanks
12 Screw connection
13-16 Pipe elements
17 Pipe swivel joint
18,19 Sections of pipe element 14
20 Pipe swivel joint
21 Pipe swivel joint
22 Pipe swivel joint
A Base at vessel S
B Width of vessel S
D Deck of the vessel
L Longitudinal axis of filler neck 2
R Fuel hose
RE Inflow direction of the fuel into filler neck 2
RA Outflow direction RA of the fuel into the first pipe element 13
S Vessel
S1,S2 Longitudinal sides of vessel S
T Tank
V Supply vessel
VL Service pipe
W Minimum swivel range of filler neck 2 from 300° through 180° to 60° (pursuant to compass rose)
X5 Pivot axis of pivot bearing 5
X7 Pivot axis of bearing 7
X17 Pivot axis of pipe swivel joint 17
X20 Pivot axis of the second pipe swivel joint 20
X21 Pivot axis of the third pipe swivel joint 21
X22 Pivot axis of the fourth pipe swivel joint 22

The invention claimed is:

1. An apparatus for transferring a fluid to a tank of a vessel using an external fuel hose element, the tank including a flange, the vessel also including a superstructure stationary in relation to the tank, the apparatus comprising:

a bearing that is stationary in relation to the tank, the bearing defined at a holder configured to be attached to the superstructure of the vessel;

a filler neck configured to receive the external fuel hose element, the filler neck being pivotally mounted about the bearing by connection to a holding element extending between the filler neck and the holder; and a pipe coupling the filler neck with the flange of the tank, the pipe including a plurality of pipe elements that are rotatably coupled, at least in part, to each other and to the flange, and the pipe elements shaped such that the filler neck is pivotable about only a first pivot axis and a second pivot axis, wherein the first and second pivot axes are aligned vertically relative to each other and transversely relative to a longitudinal axis of the filler neck, wherein the first pivot axis is aligned vertically in relation to the vessel and the second pivot axis is aligned horizontally in relation to the vessel, wherein the pipe and the holding element are separately coupled to the filler neck.

2. The apparatus of claim 1 wherein one of pipe elements has a rotation axis that is coaxially aligned with the first pivot axis or with the second pivot axis.

3. The apparatus of claim 1 wherein adjoining pairs of the pipe elements are connected to each other by a pipe swivel joint.

4. The apparatus of claim 3 wherein one of the pipe swivel joints has a rotation axis that is aligned vertically to a rotation axis of at least another of the pipe swivel joints.

5. The apparatus of claim 1 wherein the pipe is formed by four pipe elements.

6. The apparatus of claim 1 wherein the pipe is connected to the flange by a pipe swivel joint.

7. The apparatus of claim 1 wherein the pipe is connected to the filler neck in a rotationally fixed manner.

8. The apparatus of claim 1 wherein the second pivot axis is spaced from the first pivot axis of the bearing.

9. The apparatus of claim 1 wherein the holding element being pivotable about the first pivot axis, and the filler neck being mounted pivotably about the second pivot axis at the holding element.

10. The apparatus of claim 1 wherein the filler neck is pivotable about the first pivot axis within a range of at least 240° and about the second pivot axis within a range of at least 60°.

11. The apparatus of claim 1 wherein the filler neck is detachably connected to the pipe.

12. The apparatus of claim 1 further comprising: a securing means for stashing and/or securing the apparatus.

13. A vessel including the apparatus of claim 1.

14. The vessel of claim 13 wherein the vessel includes a hull, a deck, and the superstructure on the deck, the tank is arranged in the hull, and the filler neck is arranged at the superstructure.

15. The vessel of claim 13 wherein the apparatus is designed and arranged such that the filler neck is pivotable by at least +/−30° degrees in relation to the athwartship direction.

16. The apparatus of claim 1, wherein the holding element is a U-shaped element connected by pins defining pivot axes with each of the holder and the filler neck.

* * * * *